US009316066B2

(12) United States Patent
MacMillan et al.

(10) Patent No.: US 9,316,066 B2
(45) Date of Patent: Apr. 19, 2016

(54) REDEPLOYABLE SUBSEA MANIFOLD-RISER SYSTEM

(75) Inventors: Adrian Armstrong MacMillan, Floreat (AU); Nigel James Palmer, East Victoria Park (AU)

(73) Assignee: Woodside Energy Technologies Pty Ltd., Perth Wa (AU)

( * ) Notice: Subject to any disclaimer, the term of this patent is extended or adjusted under 35 U.S.C. 154(b) by 0 days.

(21) Appl. No.: 14/345,017

(22) PCT Filed: Sep. 14, 2012

(86) PCT No.: PCT/AU2012/001101
§ 371 (c)(1),
(2), (4) Date: Jan. 9, 2015

(87) PCT Pub. No.: WO2013/037002
PCT Pub. Date: Mar. 21, 2013

(65) Prior Publication Data

US 2015/0107845 A1 Apr. 23, 2015

(30) Foreign Application Priority Data

Sep. 16, 2011 (AU) ..... 2011903801
Oct. 4, 2011 (AU) ..... 2011904090

(51) Int. Cl.

| | |
|---|---|
| ***E21B 19/00*** | (2006.01) |
| ***E21B 33/038*** | (2006.01) |
| ***E21B 17/01*** | (2006.01) |
| ***E21B 43/01*** | (2006.01) |
| ***E21B 43/12*** | (2006.01) |
| ***B63B 35/00*** | (2006.01) |
| ***F17C 13/08*** | (2006.01) |

(52) U.S. Cl.
CPC ..... *E21B 19/002* (2013.01); *B63B 35/00* (2013.01); *E21B 17/01* (2013.01); *E21B 19/004* (2013.01); *E21B 33/038* (2013.01); *E21B 43/01* (2013.01); *E21B 43/0107* (2013.01); *E21B 43/12* (2013.01); *F17C 13/082* (2013.01)

(58) Field of Classification Search
CPC ... E21B 19/002; E21B 19/004; E21B 33/038; E21B 17/01; E21B 43/0107; E21B 43/12; E21B 43/01; E21B 17/012
USPC ..... 166/357, 366–369, 359, 350–352; 405/224.2–224.4
See application file for complete search history.

(56) References Cited

U.S. PATENT DOCUMENTS 3,261,398 A * 7/1966 Haeber ..... 166/352
3,387,459 A * 6/1968 Manning ..... 405/205

(Continued)

OTHER PUBLICATIONS

Written Opinion of the International Searching Authority, PCT/AU2012/001101, Oct. 25, 2012, 4 pages.

*Primary Examiner* — James G Sayre
(74) *Attorney, Agent, or Firm* — Edell, Shapiro & Finnan, LLC

(57) ABSTRACT

A subsea manifold-riser system is redeployed from a first production location to a second production location. A manifold module is lowered to the ocean floor at the first production location using a marine riser as a running tool by adding threaded pipe sections to the upper end of the marine riser. The manifold module is raised from the ocean floor at the first production location for redeployment at the second production location using the marine riser as a retrieval tool by removing threaded pipe sections from the upper end of the marine riser.

52 Claims, 6 Drawing Sheets

(56) References Cited

U.S. PATENT DOCUMENTS

| | | | | | |
|---|---|---|---|---|---|
| 3,424,241 | A | * | 1/1969 | Triplett | 166/340 |
| 3,961,490 | A | * | 6/1976 | Corgnet | 405/202 |
| 4,127,003 | A | * | 11/1978 | Vilain | 405/202 |
| 4,152,088 | A | * | 5/1979 | Vilain | 405/195.1 |
| 4,194,568 | A | * | 3/1980 | Buresi et al. | 166/340 |
| 4,281,716 | A | * | 8/1981 | Hall | 166/339 |
| 4,398,846 | A | | 8/1983 | Agdern | |
| 4,462,717 | A | * | 7/1984 | Falcimaigne | 405/224.3 |
| 4,545,437 | A | * | 10/1985 | Denison | 166/345 |
| 4,632,603 | A | * | 12/1986 | Baugh | 405/224.3 |
| 4,661,016 | A | * | 4/1987 | Baugh et al. | 405/169 |
| 4,673,313 | A | * | 6/1987 | Baugh et al. | 405/224.3 |
| 4,687,380 | A | * | 8/1987 | Meek et al. | 405/204 |
| 6,752,100 | B2 | * | 6/2004 | Guinn et al. | 114/258 |
| 2001/0013414 | A1 | * | 8/2001 | Fitzgerald et al. | 166/366 |
| 2001/0030045 | A1 | * | 10/2001 | Roberts et al. | 166/367 |
| 2008/0138159 | A1 | * | 6/2008 | Daniel et al. | 405/224.3 |
| 2008/0223583 | A1 | * | 9/2008 | Roveri et al. | 166/336 |
| 2009/0044950 | A1 | | 2/2009 | Boudreau | |
| 2012/0292040 | A1 | * | 11/2012 | Prescott | 166/345 |

* cited by examiner

REDEPLOYABLE SUBSEA MANIFOLD-RISER SYSTEM

FIELD OF THE INVENTION

The present invention relates to a subsea manifold-riser system for use in producing formation fluids from a hydrocarbon reservoir located offshore. The present invention relates particularly but not exclusively to methods of redeploying a subsea manifold module from one producing location to another.

BACKGROUND TO THE INVENTION

Subsea wells are drilled at water depths ranging from fifty to several thousand feet and a variety of techniques are employed to effect first the drilling of each well and then the installation of completion and production equipment to remove formation fluids from a reservoir. Offshore production of natural gas traditionally requires a large investment in expensive drilling and production equipment to be made. Where there are insufficient reserves in a given reservoir or the reserves are small but dispersed, the unit cost of development at that production location becomes prohibitively high. This problem is particularly acute for complex reserves in deepwater locations.

There remains a need to reduce the costs associated with production to reduce cost exposure in the event of a poor reservoir production outcome.

All of the patents cited in this specification, are herein incorporated by reference. It will be clearly understood that, although a number of prior art publications are referred to herein, this reference does not constitute an admission that any of these documents forms part of the common general knowledge in the art, in Australia or in any other country. In the summary of the invention, the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

SUMMARY OF THE INVENTION

According to a first aspect of the present invention there is provided a method for redeployment of a subsea manifold-riser system from a first production location to a second production location, the system comprising:

- a production flow control device for regulating the flow of formation fluids from a subsea well at a first production location;
- a subsea manifold module including connection terminals the subsea manifold module being positioned in use on the ocean floor adjacent to but spaced apart from the production flow control device;
- a releasable connection means installed between the production flow control device and the connection terminal for delivering formation fluids from the production flow control device to the manifold module; and,
- a marine riser comprising a plurality of threaded pipe sections for delivering formation fluids from the manifold module to a floating production facility, the marine riser having an upper end and a lower end; and,
- a coupling means for coupling the subsea manifold module to the lower end of the marine riser in a sealing manner;

the method comprising the steps of:

a) lowering the manifold module to the ocean floor at the first production location using the marine riser as a running tool by adding threaded pipe sections to the upper end of the marine riser; and, b) raising the manifold module from the ocean floor at the first production location for redeployment at a second production location using the marine riser as a retrieval tool by removing threaded pipe sections from the upper end of the marine riser.

In one form, the upper end of the marine riser includes a tensioning means positioned at the upper end of the marine riser for maintaining tension on the marine riser in use. In one form, the tensioning means is a buoyancy module. In one form, the buoyancy module is positioned below the surface of the water. In one form, the buoyancy module is positioned between 30 and 100 meters below the surface of the water. In one form, the tensioning means is retrieved from the first production location for re-deployment at the second production location. In one form of the method, the system further comprises a flexible fluid connector for directing the flow of formation fluids from the marine riser or tension means to a floating production unit. The floating production unit may be a floating production vessel, a floating production and storage vessel, a semisubmersible, a spar, a compressed natural gas carrier or a floating liquefied natural gas (LNG) production facility. In one form, the floating production unit is fluidly coupled to the fluid connector using a mooring system comprising one or more disconnectable submersible mooring buoys, each mooring buoy kept in place by a plurality of mooring lines. In one form, the production flow control device remains at the first production location while the manifold module and marine riser are moved from the first production location to the second production location. In one form, the method further comprises the step of suspending or abandoning the subsea well and retrieving the production flow control device from the first production location for re-use at the second production location after retrieval of the manifold module and marine riser.

In one form, the marine riser and manifold module are raised and then towed as an assembly from the first production location to the second production location, and wherein the manifold module remains sealingly coupled to the lower end of the marine riser whilst the assembly is being towed from the first production location to the second production location. In one form, the assembly includes the tensioning means. In one form, the assembly includes the mooring system. In one form, the tensioning means is disconnected from the upper end of the marine riser to remove a sufficient number of the plurality of threaded sections of pipe from the upper end of the marine riser to provide a selected offset between the manifold module and the ocean floor while the assembly is being towed from a first production location to a second production location. In one form, the marine riser is partially or fully disassembled during step b) by removing threaded pipe sections from the upper end of the marine riser in a controlled manner. In one form, the production flow control device connected to the manifold module is located no more than five kilometers apart from the manifold module.

In one form, the system further comprises a subsea drilling template having a plurality of spaced apart drill guide slots for guiding the position of at least two subsea wells according to a selected drilling pattern. In one form, the manifold module includes a releasable coupling means for releasable engagement with the subsea drilling template, whereby in use, the manifold module is released from the subsea drilling template to allow the manifold module to be raised using the marine riser as the retrieval tool for redeployment from the first production location to the second production location. In one form, the method further comprises the step of anchoring the manifold module to the ocean floor at the first production location using an anchoring means. In one form, the subsea well includes a wellhead installed at an upper end of a casing string, the wellhead being located at one of the plurality of drill guide slots of the subsea drilling template and wherein the casing string is the anchoring means for the manifold module.

In one form, a first drilling template is located adjacent to but spaced apart from a second template at the first production location and the first drilling template is fluidly coupled with the second drilling template. In one form, the first and second drilling templates share a common manifold module and a common marine riser. In one form, the subsea drilling template is adjacent to but spaced apart from an off-template well and a connection means is provided between a production flow control device associated with the off-template well and the manifold module releasably coupled to the subsea drilling template. In one form, the off-template well is a pre-existing exploration well. In one form, the subsea well is one of a plurality of subsea wells and the production flow control device is one of a corresponding plurality of production flow control devices.

According to a second aspect of the present invention there is provided a redeployable subsea manifold-riser system comprising:

- a production flow control device for regulating the flow of formation fluids from a subsea well at a first production location;
- a subsea manifold module including a manifold and a connection terminal, the subsea manifold module being positioned in use on the ocean floor, adjacent to but spaced apart from the production flow control device;
- a releasable connection means installed between the production flow control device and the connection terminal for delivering formation fluids from the production flow control device to the manifold module; and,
- a marine riser comprising a plurality of threaded pipe sections for delivering formation fluids from the manifold module to a floating production facility, the marine riser having an upper end and a lower end;
- a coupling means for coupling the subsea manifold module to the lower end of the marine riser in a sealing manner;
- whereby, in use, the manifold module is lowered to the ocean floor at the first production location using the marine riser as a running tool by adding threaded pipe sections to the upper end of the marine riser; and, the manifold module is raised from the ocean floor at the first production location for redeployment at a second production location using the marine riser as a retrieval tool by removing threaded pipe sections from the upper end of the marine riser.

In one form, the upper end of the marine riser includes a tensioning means positioned at the upper end of the marine riser for maintaining tension on the marine riser in use. In one form, the tensioning means is a buoyancy module. In one form, the buoyancy module is positioned below the surface of the water. In one form, the buoyancy module is positioned between 30 and 100 m meters below the surface of the water. In one form, the tensioning means is retrieved from the first production location for re-deployment at the second production location. In one form, the system further comprises a flexible fluid connector for directing the flow of formation fluids from the marine riser or tension means to a floating production unit. In one form, the floating production unit is a floating production vessel, a floating production and storage vessel, a semisubmersible, a spar, a compressed natural gas carrier or a floating liquefied natural gas (LNG) production facility. In one form, the floating production unit is fluidly coupled to the fluid connector using a mooring system comprising one or more disconnectable submersible mooring buoys, each mooring buoy kept in place by a plurality of mooring lines. In one form, the production flow control device remains at the first production location while the manifold module and marine riser are moved from the first production location to the second production location. In one form, the subsea well is abandoned or suspended for retrieval of the production flow control device from the first production location for re-use at the second production location after retrieval of the manifold module and marine riser.

In one form, the marine riser and manifold module are raised and then towed as an assembly from the first production location to the second production location, and wherein the manifold module remains sealingly coupled to the lower end of the marine riser whilst the assembly is being towed from the first production location to the second production location. In one form, the assembly includes the tensioning means. In one form, the assembly includes the mooring system. In one form, the tensioning means is disconnected from the upper end of the marine riser to remove a sufficient number of the plurality of threaded sections of pipe from the upper end of the marine riser to provide a selected offset between the manifold module and the ocean floor while the assembly is being towed from a first production location to a second production location. In one form, the marine riser is partially or fully disassembled by removing threaded pipe sections from the upper end of the marine riser in a controlled manner. In one form, the production flow control device connected to the manifold module is located no more than five kilometers apart from the manifold module.

In one form, the system further comprises a subsea drilling template having a plurality of spaced apart drill guide slots for guiding the position of at least two subsea wells according to a selected drilling pattern. In one form, the manifold module includes a releasable coupling means for releasable engagement with the subsea drilling template, whereby in use, the manifold module is released from the subsea drilling template to allow the manifold module to be raised using the marine riser as the retrieval tool for redeployment from the first production location to the second production location. In one form, the system further comprises an anchoring means for anchoring the manifold module to the ocean floor at the first production location. In one form, the subsea well includes a wellhead installed at an upper end of a casing string, the wellhead being located at one of the plurality of drill guide slots of the subsea drilling template and wherein the casing string is the anchoring means for the manifold module. In one form, a first drilling template is located adjacent to but spaced apart from a second template at the first production location and the first drilling template is fluidly coupled with the second drilling template. In one form, the first and second drilling templates share a common manifold module and a common marine riser. In one form, the subsea drilling template is adjacent to but spaced apart from an off-template well and a connection means is provided between a production flow control device associated with the off-template well and the manifold module releasably coupled to the subsea drilling template. In one form, the off-template well is a pre-existing exploration well. In one form, the subsea well is one of a plurality of subsea wells and the production flow control device is one of a corresponding plurality of production flow control devices.

BRIEF DESCRIPTION OF THE DRAWINGS

In order to facilitate a more detailed understanding of the nature of the invention several embodiments of the present invention will now be described in detail, by way of example only, with reference to the accompanying drawings, in which.

Figure 1:
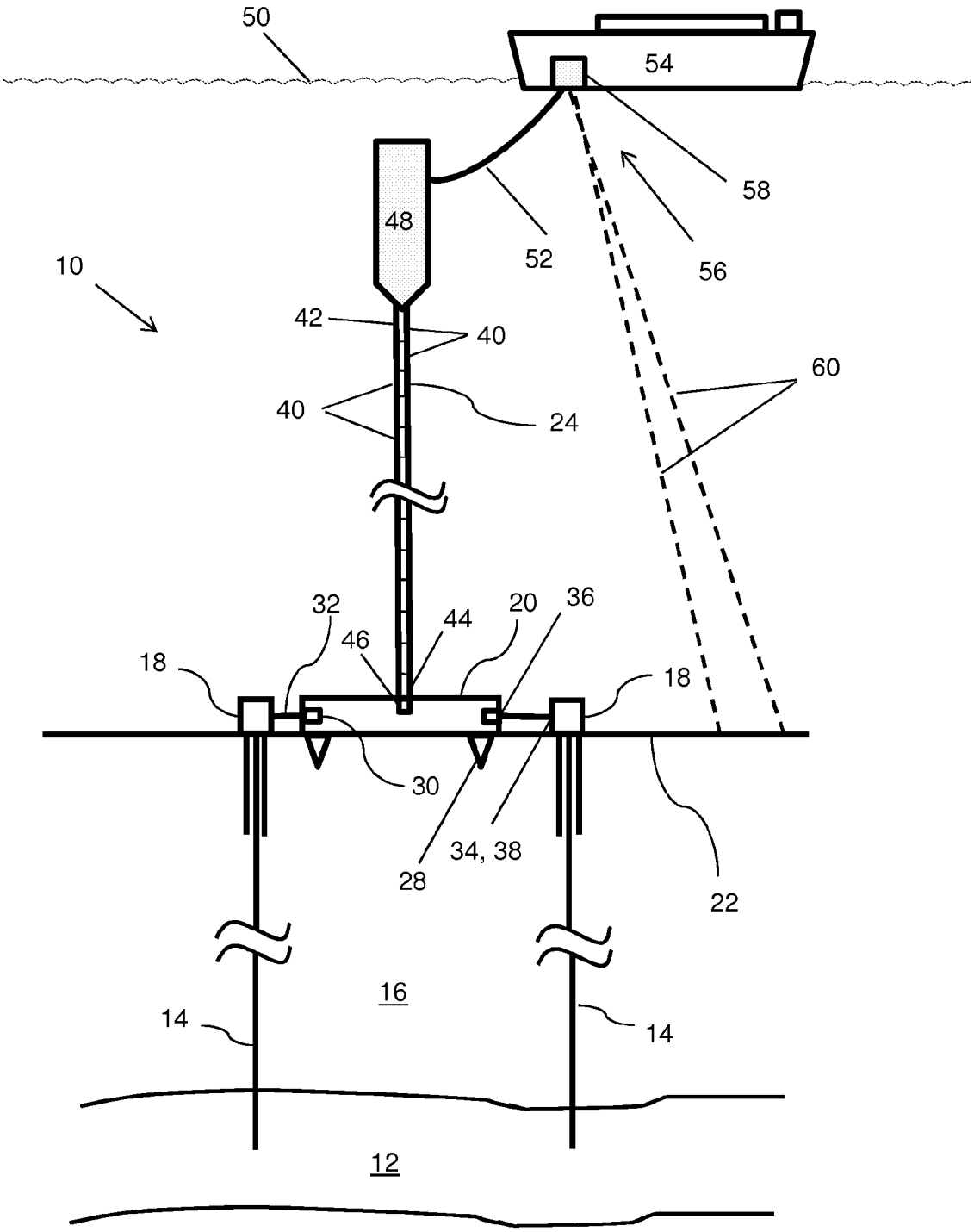
FIG. 1 is a schematic illustration of a first embodiment of the redeployable subsea manifold-riser system of the present invention at a first production location.

It is to be noted that the drawings illustrate only preferred embodiments of the invention and are therefore not to be considered limiting of the invention's scope as it may admit to other equally effective embodiments. Like reference numerals refer to like parts. The components in the figures are not necessarily to scale, emphasis instead being placed upon illustrating the principles of the invention. Moreover, all drawings are intended to convey concepts, where relative sizes, shapes and other detailed attributes may be illustrated schematically rather than literally or precisely.

DETAILED DESCRIPTION OF PREFERRED EMBODIMENTS

Particular embodiments of the method and system for producing gas from a plurality of subsea wells are now described. The terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs.

A first embodiment of the redeployable subsea manifold-riser system (10) of the present invention is now described with reference to FIG. 1 in which there is provided a schematic illustration of the production phase of a subsea reservoir (12). During the production phase, formation fluids from the reservoir are being extracted from the reservoir in a controlled manner from one or more subsea wells (14) which have been drilled and completed at a first production location (16). The flow of formation fluids from each of the subsea wells is regulated using a production flow control device (18) known in the art. By way of example, the production flow control device is a wet Christmas tree positioned on top of the wellhead of each subsea well. Using embodiments of the present invention, a subsea manifold module (20) is lowered to the ocean floor (22) and positioned adjacent to but spaced apart from the one or more subsea wells using a marine riser (24) as a running tool. As described in greater detail below, the marine riser is later used as a retrieval tool to allow for redeployment of the marine riser and the manifold module from the first production location (16) to a second production location (26). The marine riser and manifold module are thus run and retrieved for redeployment as a manifold-riser system. With reference to FIG. 1, a first embodiment of the redeployable subsea manifold-riser system of the present invention is shown in position on the ocean floor at the first production location.

The manifold module is provided with an anchoring means (28) to maintain its position and orientation on the ocean floor. Examples of suitable anchoring means include an anchor assembly attached to a mud mat, a clump weight, one or more suction piles, or, one or more casing strings installed in the ocean floor as discussed in greater detail below. To assist in its correct positioning, the manifold module may be provided with a means for orienting the manifold module relative to the position of the at least two subsea wells. A remotely operated vehicle ("ROV") may be used to assist in orienting the position of the manifold module if required. The manifold module may be provided with a protective cage surrounding a manifold if desired.

The manifold module includes a manifold comprising pipes, valves, control lines, one or more connection terminals (30). A connection means (32), such as a rigid or flexible jumper, is installed between each production flow control device and the manifold. The connection means may equally be a flow line if the manifold is connected with a subsea well that is located at a distance greater than 50 meters from the manifold. The connection means has a first end (34) and a second end (36). The connection means is connected at its first end in a sealing manner to the production flow control device and is connected at its second end in a sealing manner to a connection terminal provided on the manifold module. To avoid the need to provide continuous hydrate management, it is preferable for the production flow control devices connected to the subsea manifold module to be located within 5 km from the subsea manifold module. The actual location distances between the production flow control devices and the subsea manifold module will be determined by several factors relating to the likelihood of hydrate formation. The distance may be increased with additional insulation of the tie back flowline.

In use during the production phase, the manifold module receives formation fluids from the production flow control device of each of the subsea wells at the first production location and delivers a single stream of formation fluids to the surface via the marine riser. A typical marine riser is made up of a plurality of pipe sections, each section being made up, by way of example, of 20 inch steel pipe in stands which may be 20 to 40 feet long. New pipe sections are added at the surface as the marine riser is lowered to the ocean floor in a controlled manner. In the embodiment illustrated in FIG. 1, the marine riser (24) has an upper end (42) and a lower end (44), the lower end being that end of the marine riser which extends, in use, downwardly from the surface of the water towards the ocean floor.

Using the redeployable subsea manifold-riser system of the present invention, the marine riser (24) is made up of a plurality of threaded sections of pipe (40) with new sections of pipe being added to the upper end at the surface so that the lower end (44) of the marine riser (24) is run towards the ocean floor (22) in a controlled manner. The lower end of the marine riser is coupled to the manifold module (20) in a sealing manner using a suitable coupling means (46). The upper end of the marine riser is provided with a tensioning means (48), such as a buoyancy module positioned at the upper end (42) of the marine riser (24). The tensioning means is used to keep the marine riser in tension and as vertical as possible to reduce the risks associated with the formation of hydrates and keep the cost of construction and mobilisation of the marine riser to a minimum. With reference to FIG. 1, when construction of the marine riser is completed, the manifold module is positioned at the ocean floor and the buoyancy module is positioned below the surface (50) of the water at a depth that is below the effect of waves to minimise environmental loads on the marine riser. By way of example, the buoyancy module may be positioned between 30 and 100 m meters below the surface of the water so as to keep the marine riser vertical whilst maintaining tension on the marine riser at all times.

The formation fluids extracted from the reservoir (12) at the first production location (16) are directed via the marine riser (24) and through a flexible fluid connector (52), such as a flexible jumper, to a floating production unit (54). Examples of suitable floating production units include a floating production vessel, a floating production and storage vessel, a semisubmersible, a spar, a compressed natural gas carrier or a floating liquefied natural gas (LNG) production facility. With reference to FIG. 1, the floating production unit (54) is fluidly coupled to the fluid connector (52) using a mooring system (56) comprising one or more disconnectable submersible mooring buoys (58), each of which is kept in place by a plurality of mooring lines (60). Using this arrangement, the floating production unit is able to weathervane around a given mooring buoy during loading at the first production location.

If insufficient formation fluids are found at the first production location (16) or the rate of production of formation fluids at the first production location drops below economic limits, then the production phase is discontinued at the first production location. In one embodiment of the present invention, each of the one or more subsea wells (14) is suspended or abandoned and the subsea manifold-riser system (10) comprising the marine riser (24) and manifold module (20) are recovered for redeployment at a second production location (26). To facilitate recovery and redeployment of the manifold module (20), a releasable connector (38) is deployed at one or both of the first end (34) and second end (36) of each connection means (32) to allow disconnection and recovery of the manifold module when the production phase at the first production location has been completed. After each connection means (32) has been disconnected, the Christmas trees (18) are left behind at the first production location (16) whilst the manifold module (20), marine riser (24) and buoyancy module (48) are moved from the first production location (16) to the second production location (26). Because the Christmas trees are independent of the manifold module, the one or more subsea wells at the first production location can be suspended or abandoned to allow the Christmas trees to be retrieved from the first production location for re-use at another production location if desired. Advantageously, retrieval of the Christmas trees can be achieved using workover or intervention vessels which are generally smaller than mobile offshore drilling units.

In one embodiment of the present invention, the buoyancy module (48), marine riser (24) and manifold module (20) are retrieved to surface and disassembled at the first production location (16) and then reassembled for re-deployment at the second production location (26). In this example, the anchoring means (28) is released to allow the manifold module (20) to be retrieved to surface (50). The marine riser (24) is disassembled at each of the plurality of threaded sections of pipe (40) in a controlled manner as the marine riser (24) is retrieved from the ocean floor (22) for later re-assembly at the second production location (26). The manifold module (20) remains sealingly coupled to the lower end (46) of the marine riser (24) whereby the manifold module is retrieved to the surface in a controlled manner using the marine riser as a retrieval tool during the marine riser recovery operation. Using a threaded marine riser in this way allows for the length of the marine riser to be tailored to suit vastly different water depths at different production locations.

Figure 2:
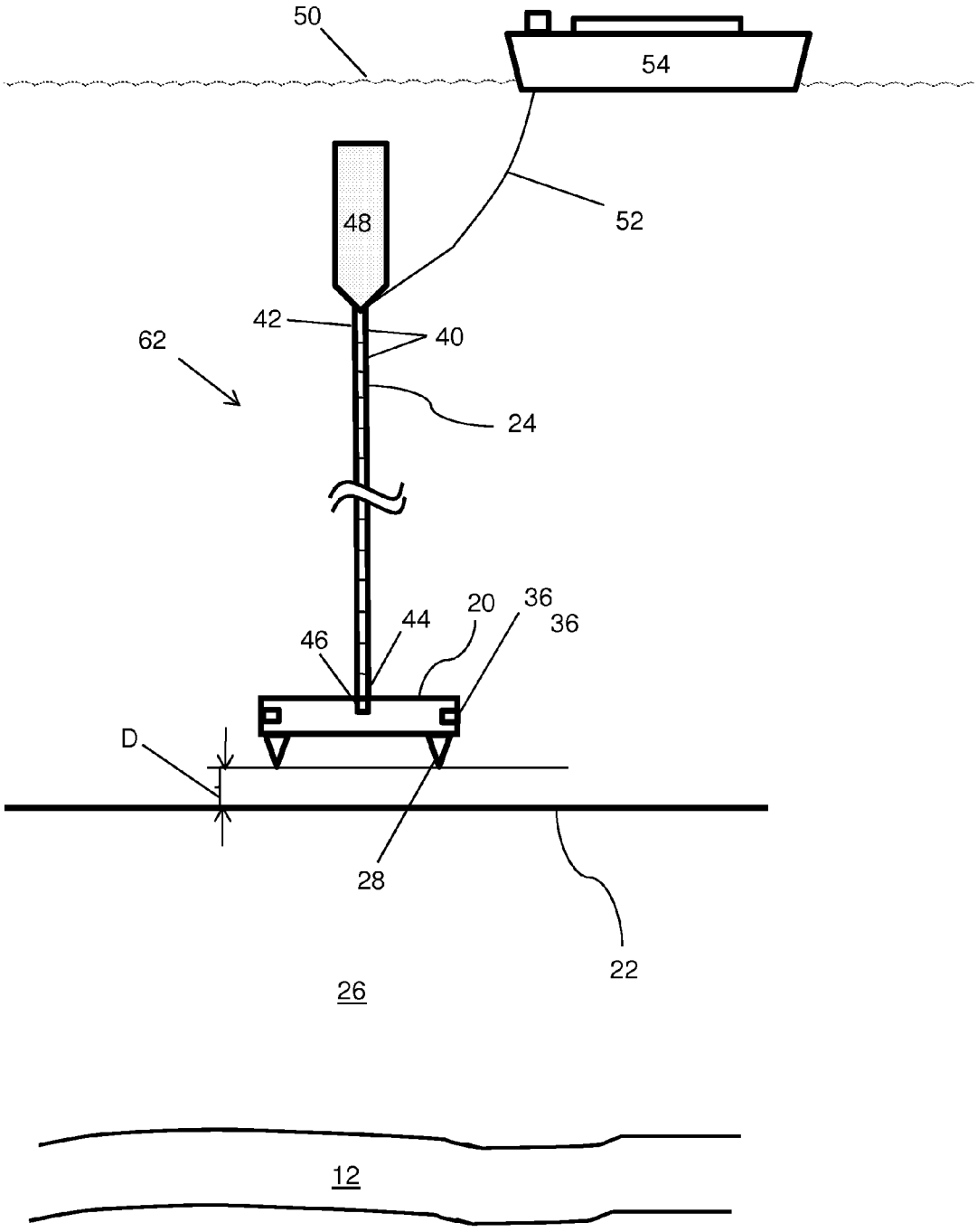
FIG. 2 is a schematic illustration of the subsea manifold-riser system after being towed from a first production location to a second production location.

In an alternative embodiment now described with reference to FIG. 2, the marine riser (24) and manifold module (20) has been picked up and towed as an assembly (62) from the first production location (16) to the second production location (26). As with the previous embodiment, the manifold module (20) remains sealingly coupled with the lower end (46) of the marine riser (24) at all times. Advantageously, leaving the manifold module in place at the lower end of the marine riser prevents the ingress of seawater into the marine riser whilst the assembly is being towed from the first production location to the second production location. The buoyancy module is deballasted using air or another suitable fluid to help to raise the buoyancy module (48), marine riser (24) and manifold module (20) as the assembly (62) towards the surface of the water (50). In the embodiment illustrated in FIG. 2, the assembly (62) that is towed from the first production location (16) to the second production location (26) includes the buoyancy module (48) and the mooring system (56). Alternatively, the buoyancy module (48) may be disconnected from the upper end (42) of the marine riser (24) to allow a sufficient number of the plurality of threaded sections of pipe (40) to be removed at the upper end of the marine riser so as to provide a selected offset (labelled as "D" in FIG. 2) between the manifold module (20) and the ocean floor (22). This offset "D" is created to ensure that clearance is maintained between the manifold module and the ocean floor at all times while the assembly is being towed from a first production location to a second production location.

In either embodiment, the manifold module (20) and a non-recovered section of the marine riser (24) remain below the surface of the water (50) as the assembly (62) is towed from the first production location (16) to the second production location (26). Towing of the assembly (62) is particularly advantageous for use in circumstances where the first production location is located in proximity to the second production location (within 1 to 20 km from each other). This embodiment provides significant savings in the time and vessel functionality otherwise spent in disassembly of the marine riser at the first production location and subsequent reassembly of the marine riser at the second production location. Advantageously, towing of the assembly may be conducted using a workover or intervention vessel instead of using a more expensive mobile offshore drilling unit. The mobile offshore drilling unit is thus available to conduct drilling operations at another production location during retrieval and redeployment of the manifold/riser system.

Figure 3:
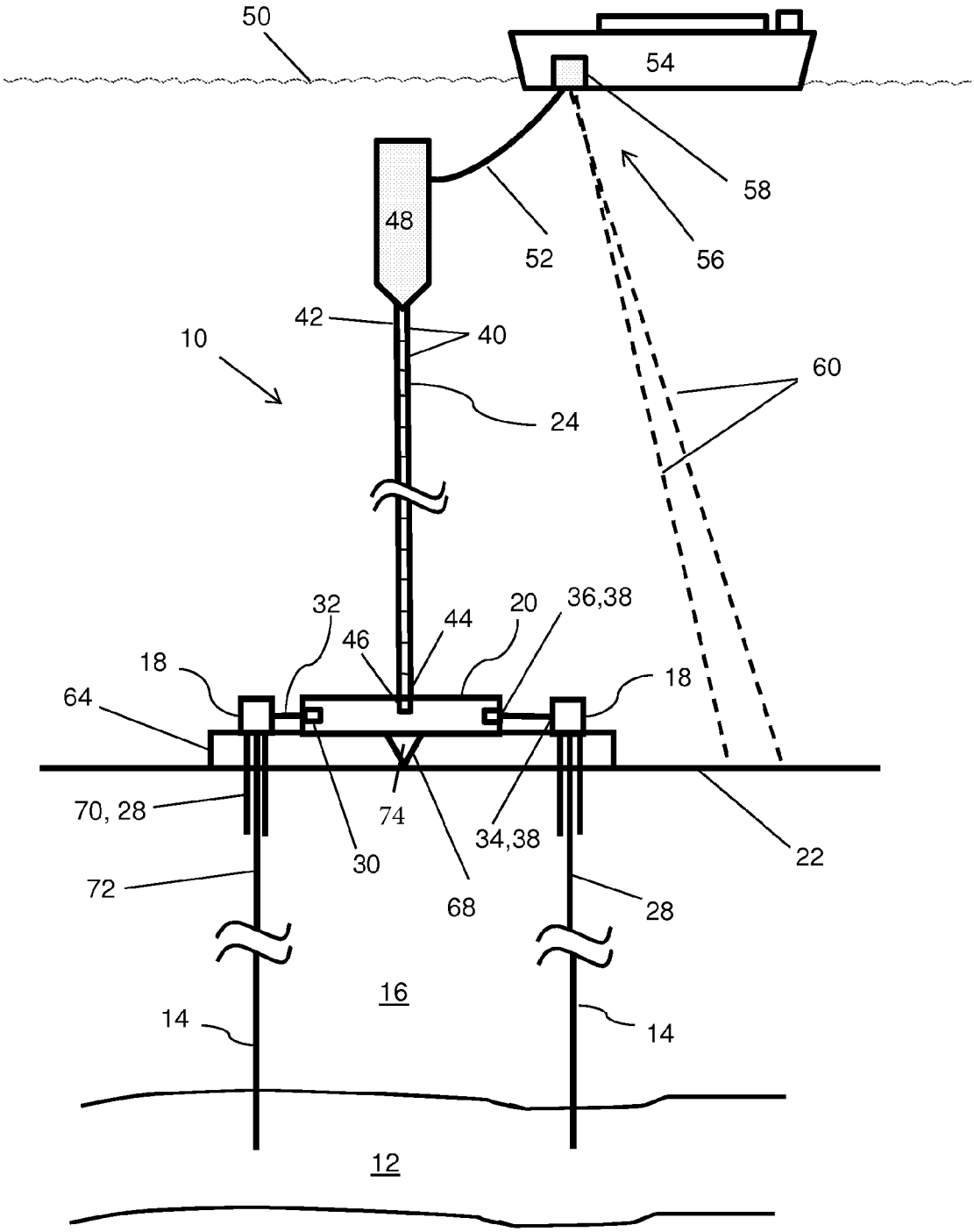
FIG. 3 is a schematic illustration of an embodiment of the redeployable subsea manifold-riser system of the present invention including a subsea drilling template at a first production location.

A fourth embodiment of the present invention is now described with reference to FIGS. 3 and 4 in which the first production location (16) includes a subsea drilling template (64) which is used to guide the position of the at least two subsea wells (14) according to a selected drilling pattern. In FIG. 3, the subsea drilling template (64) is shown in position on the ocean floor (22) at the first production location (16), having been lowered into position using methods known in the art. The subsea drilling template may be provided with an anti-rotation device (not shown), for example a skirt or a set of wings, to assist in the positioning of the template in the desired orientation on the ocean floor. The template may also be provided with a means for leveling the template in position on the ocean floor (not shown) to satisfy the alignment requirements of the drilling, production and/or completion equipment which is subsequently connected through the subsea drilling template to the various wells drilled beneath the footprint covered by the template.

Figure 4:
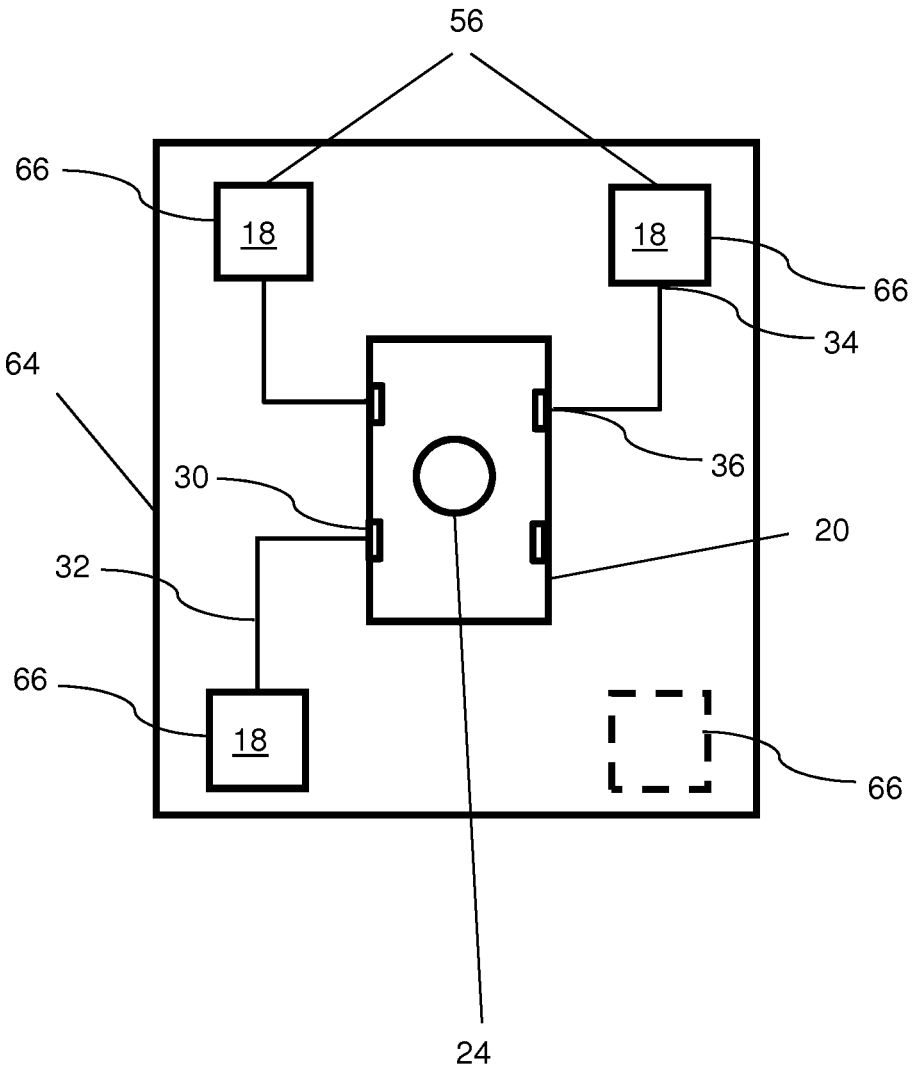
FIG. 4 is a plan view of a subsea drilling template.

With reference to FIG. 4, the subsea drilling template (64) has a frame-like structure with a plurality of spaced apart drill guide slots (66) or collars through which drilling, casing, completion, production or workover equipment can pass during subsequent drilling, casing, completion or workover operations, respectively. One embodiment of a subsea drilling template which has a generally rectangular footprint is now described with reference to FIG. 4. The particular footprint of the drilling template may vary so long as it roughly corresponds with the pattern of the subsea wells intended to be drilled at a particular location. By way of example, the template footprint may be triangular, pentagonal, or circular. The plurality of drill guide slots (66) are arranged in a configuration that is conducive to drilling. The number of drill guide slots provided in a given subsea drilling template will depend upon the number of subsea wells intended to be drilled at a given production location. In the embodiment illustrated in FIG. 4, four drill guide slots are shown with each guide slot located towards one of the four corners of the subsea drilling template. It is to be clearly understood that other drilling patterns can equally be selected. There is also no requirement for every drilling guide slot in a given template pattern to be used.

When the subsea drilling template is deployed through the moonpool of a mobile offshore drilling unit, the size of the drilling template may be limited by the size of the moonpool. Alternatively, the subsea drilling template may be lowered into position using a template deployment vessel operating independently of the mobile offshore drilling unit. After installation of the subsea drilling template (64), one or more subsea wells (14) are drilled, cased and completed with each of the subsea wells being spaced apart from each other according to the selected drilling pattern. In an alternative embodiment, a pre-existing subsea well, such as a previously drilled exploration well may be located at the first production location prior to the installation of the subsea drilling template. The pre-existing subsea well may be an off-template well. In this embodiment, the wellhead of the pre-existing subsea well may be used as a pile to assist in locating the position of the subsea drilling template at the first production location.

The production phase of the embodiment illustrated in FIG. 3 is now described. In this embodiment, one or more subsea wells (14) have been drilled and completed using the drilling template (64) to guide the drilling pattern. During the drilling and completion operations, a blowout preventer ("BOP") is installed above the wellhead of each of the subsea wells (14) to maintain well control. The BOP may be at surface or subsea. When the drilling, casing and completion operations have been completed, the Christmas trees (18) are installed at each wellhead to provide well control, allowing removal of the BOP for use at a second production location. After installation of the Christmas trees and removal of the BOP, the marine riser (24) which is made up of the plurality of threaded sections of pipe (40) is used to run the manifold module (20) to the ocean floor (22) in the manner described above for the embodiment illustrated in FIG. 1.

In the embodiment illustrated in FIG. 3, the manifold module (20) is provided with a releasable coupling means (68) for releasable engagement with the subsea drilling template (64) so that the manifold module (20) can be retrieved for redeployment from the first production location (16) to the second production location (26) using the methods described above in relation to FIG. 2. By way of example, the releasable coupling means (68) may be a cam actuated releasable locking means. The manifold module (20) is further provided with an alignment means (74) to ensure that the manifold module is coupled to the subsea drilling template in a selected position and orientation relative to the subsea drilling template without interfering with the independently pre-installed Christmas trees. By way of example, the alignment means (74) may be a guide post projecting from the manifold module, which guide post is brought into co-axial alignment with a corresponding guide hole in the subsea drilling template. The guide post and the guide hole include interacting guide devices, e.g. cams and slots respectively, which are brought into mutual engagement during the initial insertion of the guide post in the guide hole, and which during the further lowering of the guide post cause a rotation of the manifold module relative to the drilling template to ensure that the desired alignment between the manifold module and the drilling template is achieved. It will be understood that other alignment means can equally be used. After alignment and coupling of the manifold module (20) to the subsea drilling template (64) has been completed and verified, each Christmas tree (18) is releasably coupled to the manifold module using the connection means (32) in the manner described above in relation to the embodiment illustrated in FIG. 1.

Whilst the subsea wells (14) can be drilled in the ocean floor using any one of a number of conventional drilling techniques, a technique that is particularly advantageous for the system and method of the present invention involves the installation of a string of large diameter pipe known in the art as "a casing string", the casing string (70) being secured in place, for example, using cement. A wellhead is installed at the upper end of each casing string. In this way, each wellhead is located at one of the plurality of drill guide slots (66) of the subsea drilling template (64). A "completion string" (72) extending downwardly from a wellhead is then installed within the casing string. The completion string is used to direct the flow of formation fluids from the hydrocarbon reservoir to the wellhead when the well is deemed to be ready for production. In the embodiment illustrated in FIG. 3, the casing strings (70) of each of the one or more subsea wells (14) serve the function of the anchoring means (28) for the manifold module (20) and the marine riser (24) during the production phase. The casing strings (70) counterbalance the vertically upward force generated by the buoyancy means (48) on the marine riser (24) extending upwardly from the manifold module (20) towards the surface of the water (50).

If insufficient formation fluids are found at the first production location or the rate of production of formation fluids at the first production location drops below economic limits, then the production phase is discontinued at the first production location. Each of subsea wells is suspended or abandoned and the manifold module is recovered using the marine riser as a retrieval tool in the manner described above for the embodiment illustrated in FIG. 1. In the embodiment illustrated in FIG. 3, the releasable coupling means (68) used to attach the manifold module (20) to the subsea drilling template (64) is disconnected prior to retrieval of the manifold module (20) so that the subsea drilling template (64) is left behind with the Christmas trees (18) at the first production location (16). If desired, the subsea drilling template (64) can be retrieved for re-use at another production location after retrieval of the Christmas trees and removal of the wellheads using abandonment techniques known in the offshore drilling art.

Figure 6:
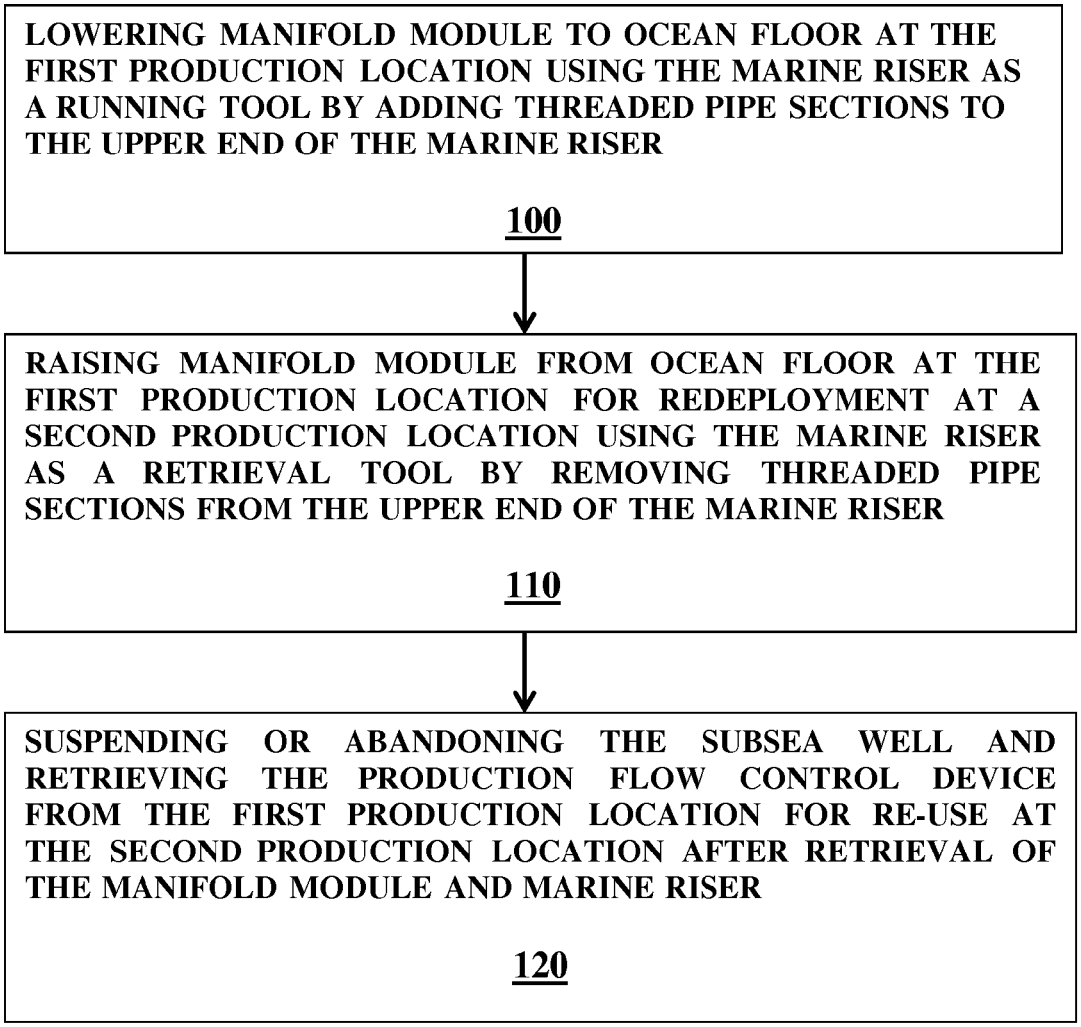
FIG. 6 is a flowchart showing example method steps for redeployment of a subsea manifold-riser system from a first production location to a second production location in accordance with the invention.

An example method is described in relation to the flowchart of FIG. 6. At 100, the manifold module is lowered to the ocean floor at a first production location using the marine riser as a running tool by adding threaded pipe sections to the upper end of the marine riser (as described herein). At 110, the manifold module is raised from the ocean floor at the first production location for redeployment at a second production location using the marine riser as a retrieval tool by removing threaded pipe sections from the upper end of the marine riser (as described herein). At 120, the subsea well is suspended or abandoned and the production flow control device from the first production location is retrieved for re-use at the second production location after retrieval of the manifold module and marine riser.

The method and system of the present invention is considered particularly suitable to providing scalable production of a plurality of stranded gas reservoirs within a hub. By way of example, the overall capacity of a hub is 1.5 trillion cubic feet ("Tcf") with five locations identified as potential production locations within the hub, each production location capable of producing 300 Tcf. The redeployable marine riser/manifold system may be used at each of the five locations in sequence, moving every two or three years as production drops off over time. The Christmas trees and subsea drilling templates can be re-used within the hub for maximum repeatability of operations to keep costs to a minimum.

Figure 5A:
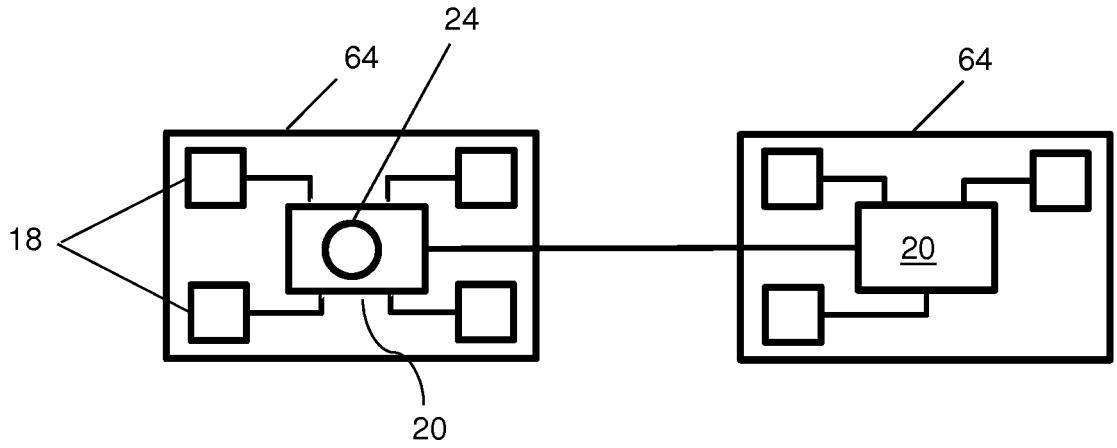
FIGS. 5*a*, 5*b* and 5*c* illustrate various configurations for locating a first subsea drilling template adjacent to but spaced apart from a second template to increase capacity at a particular production location.
Figure 5B:
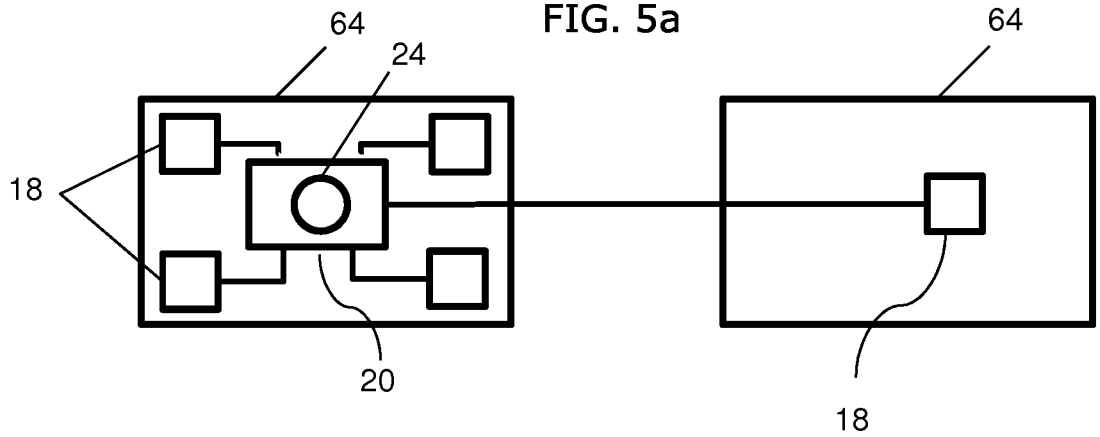
Figure 5C:
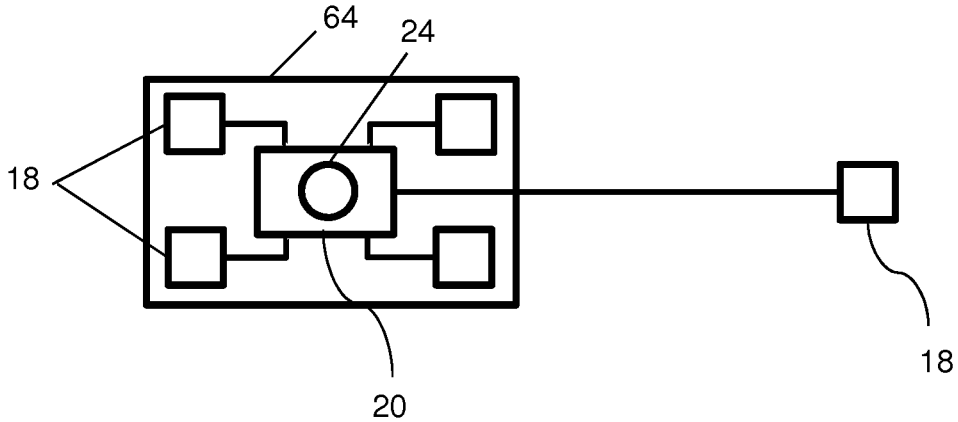

To increase capacity at a particular production location, a first template may be one of located adjacent to but spaced apart from a second template, with flowline and umbilical connections providing coupling between the first and second templates as illustrated in FIGS. 5*a*, 5*b* and 5*c*. In the embodiment illustrated in FIG. 5*a*, each subsea drilling template is provided with a corresponding manifold module. Alternatively, in the embodiment illustrated in FIG. 5*b*, the Christmas trees of the second template may be provided with jumpers such that the formation fluids from the first and second template are distributed through a common manifold located at the first template before being directed to flow through a common marine riser. In the embodiment illustrated in FIG. 5*c*, the subsea drilling template is positioned at a first production location that is adjacent to but spaced apart from an off-template well such as a pre-existing exploration well with the manifold module being installed on the subsea drilling template as described above. A jumper may then be installed to link the Christmas tree of the exploration well with one of the plurality of connection ports on the manifold.

Now that several embodiments of the invention have been described in detail, it will be apparent to persons skilled in the relevant art that numerous variations and modifications can be made without departing from the basic inventive concepts. By way of example, the marine riser can be used as the production riser. All such modifications and variations are considered to be within the scope of the present invention, the nature of which is to be determined from the foregoing description and the appended claims.

What is claimed:

1. A method for redeployment of a subsea manifold-riser system from a first production location to a second production location, the system comprising:

a production flow control device for regulating the flow of formation fluids from a subsea well at a first production location;

a subsea manifold module including connection terminals, the subsea manifold module being positioned in use on the ocean floor adjacent to but spaced apart from the production flow control device;

a releasable connection means installed between the production flow control device and the connection terminal for delivering formation fluids from the production flow control device to the manifold module; and, a marine riser comprising a plurality of threaded pipe sections for delivering formation fluids from the manifold module to a floating production facility, the marine riser having an upper end and a lower end; and, a coupling means for coupling the subsea manifold module to the lower end of the marine riser in a sealing manner;

the method comprising the steps of:

a) lowering the manifold module to the ocean floor at the first production location using the marine riser as a running tool by adding threaded pipe sections to the upper end of the marine riser; and, b) raising the manifold module from the ocean floor at the first production location for redeployment at a second production location using the marine riser as a retrieval tool by removing threaded pipe sections from the upper end of the marine riser.

2. The method of claim 1 wherein the upper end of the marine riser includes a tensioning means positioned at the upper end of the marine riser for maintaining tension on the marine riser in use.

3. The method of claim 2 wherein the tensioning means is a buoyancy module.

4. The method of claim 3 wherein the buoyancy module is positioned below the surface of the water.

5. The method of claim 4 wherein the buoyancy module is positioned between 30 and 100 meters below the surface of the water.

6. The method of claim 2 wherein the tensioning means is retrieved from the first production location for re-deployment at the second production location.

7. The method of claim 1 wherein the system further comprises a flexible fluid connector for directing the flow of formation fluids from the marine riser or tension means to a floating production unit.

8. The method of claim 7 wherein the floating production unit is a floating production vessel, a floating production and storage vessel, a semisubmersible, a spar, a compressed natural gas carrier or a floating liquefied natural gas (LNG) production facility.

9. The method of claim 7 wherein the floating production unit is fluidly coupled to the fluid connector using a mooring system comprising one or more disconnectable submersible mooring buoys, each mooring buoy kept in place by a plurality of mooring lines.

10. The method of claim 1 wherein the production flow control device remains at the first production location while the manifold module and marine riser are moved from the first production location to the second production location.

11. The method of claim 1 further comprising the step of suspending or abandoning the subsea well and retrieving the production flow control device from the first production location for re-use at the second production location after retrieval of the manifold module and marine riser.

12. The method of claim 1 wherein the marine riser and manifold module are raised and then towed as an assembly from the first production location to the second production location, and wherein the manifold module remains sealingly coupled to the lower end of the marine riser whilst the assembly is being towed from the first production location to the second production location.

13. The method of claim 12 wherein the assembly includes the tensioning means.

14. The method of claim 12 wherein the assembly includes a mooring system.

15. The method of claim 12 wherein the tensioning means is disconnected from the upper end of the marine riser to remove a sufficient number of the plurality of threaded sections of pipe from the upper end of the marine riser to provide a selected offset between the manifold module and the ocean floor while the assembly is being towed from a first production location to a second production location.

16. The method of claim 1 wherein the marine riser is partially or fully disassembled during step b) by removing threaded pipe sections from the upper end of the marine riser in a controlled manner.

17. The method of claim 1 wherein the production flow control device connected to the manifold module is located no more than five kilometers apart from the manifold module.

18. The method of claim 1 wherein the system further comprises a subsea drilling template having a plurality of spaced apart drill guide slots for guiding the position of at least two subsea wells according to a selected drilling pattern.

19. The method of claim 18 wherein the manifold module includes a releasable coupling means for releasable engagement with the subsea drilling template, whereby in use, the manifold module is released from the subsea drilling template to allow the manifold module to be raised using the marine riser as the retrieval tool for redeployment from the first production location to the second production location.

20. The method of claim 18 wherein a first drilling template is located adjacent to but spaced apart from a second template at the first production location and the first drilling template is fluidly coupled with the second drilling template.

21. The method of claim 20 wherein the first and second drilling templates share a common manifold module and a common marine riser.

22. The method of claim 18 wherein the subsea drilling template is adjacent to but spaced apart from an off-template well and a connection means is provided between a production flow control device associated with the off-template well and the manifold module releasably coupled to the subsea drilling template.

23. The method of claim 22 wherein the off-template well is a pre-existing exploration well.

24. The method of claim 1 further comprising the step of anchoring the manifold module to the ocean floor at the first production location using an anchoring means.

25. The method of claim 24 wherein the subsea well includes a wellhead installed at an upper end of a casing string, the wellhead being located at one of the plurality of drill guide slots of the subsea drilling template and wherein the casing string is the anchoring means for the manifold module.

26. The method of claim 1 wherein the subsea well is one of a plurality of subsea wells and the production flow control device is one of a corresponding plurality of production flow control devices.

27. A redeployable subsea manifold-riser system comprising:

a production flow control device for regulating the flow of formation fluids from a subsea well at a first production location;

a subsea manifold module including a manifold and a connection terminal, the subsea manifold module being positioned in use on the ocean floor, adjacent to but spaced apart from the production flow control device;

a releasable connection means installed between the production flow control device and the connection terminal for delivering formation fluids from the production flow control device to the manifold module;

a marine riser comprising a plurality of threaded pipe sections for delivering formation fluids from the manifold module to a floating production facility, the marine riser having an upper end and a lower end;

a coupling means for coupling the subsea manifold module to the lower end of the marine riser in a sealing manner;

wherein, in use, the manifold module is lowered to the ocean floor at the first production location using the marine riser as a running tool by adding threaded pipe sections to the upper end of the marine riser; and, the manifold module is raised from the ocean floor at the first production location for redeployment at a second production location using the marine riser as a retrieval tool by removing threaded pipe sections from the upper end of the marine riser.

28. The system of claim 27 wherein the upper end of the marine riser includes a tensioning means positioned at the upper end of the marine riser for maintaining tension on the marine riser in use.

29. The system of claim 28 wherein the tensioning means is a buoyancy module.

30. The system of claim 29 wherein the buoyancy module is positioned below the surface of the water.

31. The system of claim 30 wherein the buoyancy module is positioned between 30 and 100 m meters below the surface of the water.

32. The system of claim 28 wherein the tensioning means is retrieved from the first production location for re-deployment at the second production location.

33. The system of claim 27 wherein the system further comprises a flexible fluid connector for directing the flow of formation fluids from the marine riser or tension means to a floating production unit.

34. The system of claim 33 wherein the floating production unit is a floating production vessel, a floating production and storage vessel, a semisubmersible, a spar, a compressed natural gas carrier or a floating liquefied natural gas (LNG) production facility.

35. The system of claim 33 wherein the floating production unit is fluidly coupled to the fluid connector using a mooring system comprising one or more disconnectable submersible mooring buoys, each mooring buoy kept in place by a plurality of mooring lines.

36. The system of claim 27 wherein the production flow control device remains at the first production location while the manifold module and marine riser are moved from the first production location to the second production location.

37. The system of claim 27 wherein the subsea well is abandoned or suspended for retrieval of the production flow control device from the first production location for re-use at the second production location after retrieval of the manifold module and marine riser.

38. The system of claim 27 wherein the marine riser and manifold module are raised and then towed as an assembly from the first production location to the second production location, and wherein the manifold module remains sealingly coupled to the lower end of the marine riser while the assembly is being towed from the first production location to the second production location.

39. The system of claim 38 wherein the assembly includes the tensioning means.

40. The system of claim 38 wherein the assembly includes a mooring system.

41. The system of claim 38 wherein the tensioning means is disconnected from the upper end of the marine riser to remove a sufficient number of the plurality of threaded sections of pipe from the upper end of the marine riser to provide a selected offset between the manifold module and the ocean floor while the assembly is being towed from a first production location to a second production location.

42. The system of claim 27 wherein the marine riser is partially or fully disassembled by removing threaded pipe sections from the upper end of the marine riser in a controlled manner.

43. The system of claim 27 wherein the production flow control device connected to the manifold module is located no more than five kilometers apart from the manifold module.

44. The system of claim 27 wherein the system further comprises a subsea drilling template having a plurality of spaced apart drill guide slots for guiding the position of at least two subsea wells according to a selected drilling pattern.

45. The system of claim 44 wherein the manifold module includes a releasable coupling means for releasable engagement with the subsea drilling template, whereby in use, the manifold module is released from the subsea drilling template to allow the manifold module to be raised using the marine riser as the retrieval tool for redeployment from the first production location to the second production location.

46. The system of claim 44 wherein a first drilling template is located adjacent to but spaced apart from a second template at the first production location and the first drilling template is fluidly coupled with the second drilling template.

47. The system of claim 46 wherein the first and second drilling templates share a common manifold module and a common marine riser.

48. The system of claim 44 wherein the subsea drilling template is adjacent to but spaced apart from an off-template well and a connection means is provided between a production flow control device associated with the off-template well and the manifold module releasably coupled to the subsea drilling template.

49. The system of claim 48 wherein the off-template well is a pre-existing exploration well.

50. The system of claim 27 further comprising an anchoring means for anchoring the manifold module to the ocean floor at the first production location.

51. The system of claim 50 wherein the subsea well includes a wellhead installed at an upper end of a casing string, the wellhead being located at one of the plurality of drill guide slots of the subsea drilling template and wherein the casing string is the anchoring means for the manifold module.

52. The system of claim 27 wherein the subsea well is one of a plurality of subsea wells and the production flow control device is one of a corresponding plurality of production flow control devices.

* * * * *